United States Patent [19]

Bär et al.

[11] Patent Number: 4,932,808

[45] Date of Patent: Jun. 12, 1990

[54] ASSEMBLY OF PREFABRICATED STRUCTURAL COMPONENTS FOR LATTICES OR TRUSSES

[75] Inventors: Walter Bär, Horgen, Switzerland; Georg Rohles, Norderstedt, Fed. Rep. of Germany

[73] Assignees: Kanya AG, Dürnten, Switzerland; Lüdemann & Co., Norderstedt, Fed. Rep. of Germany

[21] Appl. No.: 257,329

[22] Filed: Oct. 13, 1988

[30] Foreign Application Priority Data

Oct. 14, 1987 [CH] Switzerland ..... 04018/87

[51] Int. Cl.[5] ..... F16D 1/00; F16D 3/00

[52] U.S. Cl. ..... 403/170; 403/217; 403/171; 403/172; 403/174; 403/176; 403/178; 52/648; 52/81

[58] Field of Search ..... 403/170, 176, 217, 175, 403/171, 172, 64, 174, 178, 264; 52/648, 650, 86, 81

[56] References Cited

U.S. PATENT DOCUMENTS

| | | | |
|---|---|---|---|
| 1,946,408 | 2/1934 | Loudy | 403/64 |
| 2,683,329 | 7/1954 | Kobler | 403/174 X |
| 2,868,568 | 1/1959 | Frye | 403/171 |
| 3,580,620 | 5/1971 | Offenbroich | 403/264 X |
| 3,747,261 | 7/1973 | Salem | 403/176 X |
| 3,982,841 | 9/1976 | Endzweig | 403/171 X |
| 4,017,199 | 4/1977 | Strassle | 403/264 |
| 4,251,165 | 2/1981 | Forsen | 403/362 X |
| 4,355,918 | 10/1982 | Van Vliet | 403/170 |
| 4,480,418 | 11/1984 | Ventrella | 403/176 X |

*Primary Examiner*—Randolph A. Reese
*Assistant Examiner*—Carol I. Bordas
*Attorney, Agent, or Firm*—Peter K. Kontler

[57] ABSTRACT

An assembly of prefabricated structural components for lattices or trusses includes a plurality of rod-like, load-bearing elements, a plurality of joining elements for joining the rod-like elements to one another, a plurality of connecting elements for connecting the rod-like elements to the joining elements, and a plurality of clamping elements for clamping the connecting elements and associated rod-like elements to the joining elements. Each joining element has a spherical peripheral surface provided with first and second T-grooves disposed at opposite ends of a predetermined diameter of the surface and at least one additional T-groove extending circumferentially of the surface in a plane normal to the predetermined diameter. The connecting elements resemble T-bolts and one connecting element is receivable in each first and second groove while several connecting elements are receivable in each additional groove. The connecting elements are free of threads and each connecting element has a shank which is designed to cooperate with the rod-like elements and is provided with a transverse conical recess. The clamping elements are in the form of screws having conical tips and the screws are receivable in the recesses for movement transversely of the shanks so as releasably clamp the connecting elements and associated rod-like elements to the joining elements.

10 Claims, 1 Drawing Sheet

ASSEMBLY OF PREFABRICATED STRUCTURAL COMPONENTS FOR LATTICES OR TRUSSES

BACKGROUND OF THE INVENTION

The invention relates generally to structural components for network-like structures, e.g., lattices and trusses.

More particularly, the invention relates to an assembly of prefabricated structural components for network-like structures.

A specific aspect of the invention relates to an assembly of prefabricated structural components for lattices or trusses constructed from rod-like elements which are joined to one another by joining elements. The joining elements have anchoring openings shaped like T-grooves and adapted to receive connecting elements in the form of T-bolts. The T-bolts, which serve to connect the rod-like elements to the joining elements, are free of external threads and the shank of each T-bolt is provided with a transverse conical recess. The recesses are designed to receive screws having conical ends and such screws function to releasably clamp the T-bolts and rod-like elements to the joining elements.

U.S. Pat. No. 3,982,841 teaches an assembly of prefabricated components where the joining elements are in the form of hollow spheres having essentially rectangular anchoring openings in the peripheral walls thereof. T-bolts can be inserted in the anchoring openings and are capable of fastening rod-like elements by means of threaded clamping devices. In this assembly, the limited number of slotted openings at the surfaces of the spheres restricts the ways in which the rod-like elements can be mounted. Moreover, the hollow spheres, as well as the T-bolts with their threaded clamping devices and mating nuts on the rod-like elements, are expensive to produce.

A structural assembly for mobile or temporary structures is known from the West German Offenlegungsschrift no. 3 035 698 and likewise includes rod-like and joining elements. The ends of the rod-like elements have balls constituting part of respective pivot joints and the balls are provided with flats and are designed to be arrested in complementary bearing grooves of bearing discs. Carriage bolts connect different ones of the bearing discs to one another. Rod-like elements can be coupled to the heads of the carriage bolts but it is not possible to connect rod-like elements having ball ends to the shanks of the bolts. Aside from the high cost of manufacturing the ball ends and their clamping devices, unfavorable contact pressure characteristics exist during the transfer of forces between the ball ends and the bearing grooves. Accordingly, the connecting system differs as considered along the x-axis, y-axis and z-axis of a Cartesian coordinate system. Furthermore, a complicated restraining mechanism is required for the flattened ball ends in order to prevent rotation of the same during clamping.

The Swiss patent no. 645 957 discloses an assembly of prefabricated components for lattices and trusses constructed from rod-like elements and joining elements. The joining elements are provided with anchoring openings shaped like T-grooves and engaging T-bolts which are free of external threads. The shank of each T-bolt has a conical recess extending transversely of the longitudinal axis of the bolt and a screw with a conical tip is received in each recess and is movable transversely of the respective longitudinal bolt axis. The T-bolts function to connect the rod-like elements to the joining elements. Rotation of the screws causes the T-bolts and the associated rod-like elements to be clamped to or released from the joining elements. This simple coupling or connecting system which reliably prevents rotation of the T-bolts permits the construction of lattices and trusses in which the rod-like elements extend along the x-axis, y-axis and z-axis of a Cartesian coordinate system. However, this known system cannot be employed for spherical or arcuate lattices and trusses.

OBJECTS AND SUMMARY OF THE INVENTION

It is an object of the invention to provide an assembly of prefabricated structural components which makes it possible to construct a network-like structure having elongated or rod-like elements extending along the x-axis, y-axis and z-axis of a Cartesian coordinate system as well as along rays of various angles in a polar coordinate system.

Another object of the invention is to provide an assembly of prefabricated structural components which allows elongated or rod-like elements to be added to or removed from an existing network-like structure with relative ease.

An additional object of the invention is to simplify the manufacture of an assembly of structural components for network-like structures.

A further object of the invention is to reduce the cost of an assembly of structural components for network-like structures.

It is also an object of the invention to provide a method which makes it possible to construct network-like structures having elongated or rod-like components which extend along the x-axis, y-axis and z-axis of a Cartesian coordinate system and rays of various angles in a polar coordinate system.

Yet another object of the invention is to provide a method which permits elongated or rod-like elements to be added to or removed from existing network-like structures relatively readily.

Still a further object of the invention is to provide a joining element which, by means of a single coupling system, is capable of joining elongated or rod-like elements of a network-like structure in such a manner that these elements extend along the x-axis, y-axis and z-axis of a Cartesian coordinate system as well as along rays of about 0° to about 80° in a polar coordinate system.

It is additionally an object of the invention to provide a joining element which enables elongated or rod-like elements of an existing network-like structure to be added or removed with little difficulty.

It is one more object of the invention to simplify the manufacture of the joining element and connecting system for a network-like structure.

A further object of the invention is to reduce the manufacturing costs for the joining element and connecting system of a network-like structure.

The preceding objects, as well as others which will become apparent as the description proceeds, are achieved by the invention.

In its broader sense, the invention resides in an assembly of prefabricated structural components for network-like structures. The assembly comprises a plurality of elongated load-bearing elements, e.g., rod-like elements, and a plurality of joining elements for joining different ones of the load-bearing elements to one another. Each of the joining elements has a peripheral surface and each such surface is provided with at least one anchoring groove extending circumferentially of the respective surface. The assembly further comprises a plurality of connecting elements for connecting the load-bearing elements to the joining elements and the connecting elements are designed to be anchored in the grooves.

The anchoring grooves are preferably circumferentially complete. It is further preferred for the connecting elements and anchoring grooves to be complementary to one another.

In a more specific sense, the invention is directed to an assembly of prefabricated structural components for lattices or trusses. The assembly comprises a plurality of rod-like elements and a plurality of joining elements for joining different ones of the rod-like elements to one another. Each of the joining elements has a substantially spherical peripheral surface which is provided with first and second T-grooves disposed diametrically opposite one another as considered along a predetermined diameter of the respective surface and a third T-groove extending in circumferential direction of the respective surface as considered in a predetermined plane substantially normal to the respective predetermined diameter. The T-grooves constitute anchoring passages. The assembly further comprises a plurality of connecting elements for connecting the rod-like elements to the joining elements and each such connecting element resembles a T-bolt. Each of the first and second T-grooves is designed to receive one of the connecting elements while the third T-groove is designed to receive a plurality of the connecting elements. The connecting elements are free of threads and each such element has a shank which is designed to cooperate with the rod-like elements and is provided with a transverse conical recess. The assembly also comprises a plurality of screws having conical ends and receivable in the recesses for movement transversely of the shanks so as to releasably clamp the connecting elements and associated rod-like elements to the joining elements.

The assembly of prefabricated components according to the invention makes it possible to construct spherical or curved network-like structures. Identical T-bolts free of external threads may be employed for all connections, particularly to the spherical joining elements. The rod-like or load-bearing elements may be connected so as to extend along the x-axis, y-axis and z-axis of a Cartesian coordinate system and along rays of about 0° to about 80° in a polar coordinate system. Both the joining elements and connecting system may be manufactured easily and economically.

In accordance with one embodiment of the invention, the circumferential third T-groove is centered between the diametrically opposed first and second T-grooves. Rod-like elements can be attached to the respective joining element by means of the circumferential third T-groove so as to radiate like rays in a sense from the center of the joining element outwards in all directions.

According to another embodiment of the invention, additional circumferentially extending T-grooves may be formed parallel to the circumferential third T-groove located in the central plane of a joining element. These additional circumferential T-grooves allow the attachment of T-bolts and rod-like elements in such a manner that the longitudinal axes thereof define an angle of about 30° to about 60°, preferably 45°, with the respective central plane. Each additional circumferential T-groove makes it possible to mount the T-bolts and rod-like elements so that these extend along a new ray of a polar coordinate system. If a joining element is sufficiently large, such element can be provided with a series of circumferential T-grooves respectively corresponding to rays of 0°, 30°, 45° and 60° in a polar coordinate system.

Production of the spherical joining elements can be significantly simplified and economically performed in automatic lathes or injection molding machines if the joining elements are divided into separate sections along one or more planes each of which is disposed in the region of a respective circumferential groove and is normal to the predetermined diameter between the respective diametrically opposed first and second T-grooves. The separate sections of a joining element may be connected to one another by means of a threaded bolt which is arranged so that the longitudinal axis thereof coincides with the predetermined diameter which constitutes a central axis of the joining element.

The threaded bolts may be headless and two or more separate sections of a joining element may be tightened on the respective bolt like lock nuts. The two end faces of a threaded bolt may respectively at least partly constitute the bottoms of the diametrically opposed first and second T-grooves of a joining element. This construction allows rapid assembly when the joining elements are divided into two or more separate sections The headless design of the threaded bolts permits the length of the thread to be increased so that structures capable of carrying large tensile loads can be obtained.

Production of the joining elements can be further simplified by locating dividing planes between separate sections of the joining elements in the regions of the additional circumferential grooves and arranging the dividing planes so that first bounding surfaces of the additional circumferential grooves are disposed in such planes while second bounding surfaces of the additional circumferential grooves are normal to the respective first bounding surfaces.

The diameters of the rod-like elements may be selected at will by providing cone-like rings which are designed to be interposed between the joining elements and rod-like elements in such a manner that the narrower ends of the rings confront the joining elements.

The novel features which are considered as characteristic of the invention are set forth in particular in the appended claims. The improved assembly of prefabricated components itself, however, both as to its design and the mode of using the same, will be best understood from a perusal of the following detailed description of certain specific embodiments when read in conjunction with the accompanying drawings.

DESCRIPTION OF THE PREFERRED EMBODIMENTS

Figure 1:
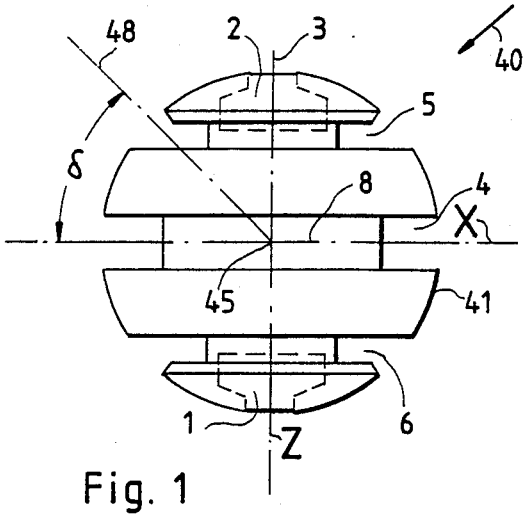
FIG. 1 is a side view of a joining element constituting part of an assembly of prefabricated structural components for use in network-like structures.

FIG. 1 illustrates a joining element 40 constituting part of an assembly of prefabricated structural components for use in the construction of network-like structures. Examples of such structures are lattices and trusses. The assembly includes a plurality of the joining elements 40 as well as a plurality of rod-like or load-bearing elements 30 (one shown in FIG. 3), a plurality of connecting elements 36,37 (one shown in FIG. 3) which function to connect the rod-like elements 30 to the joining elements 40, and a plurality of clamping elements 34 (one shown in FIG. 3) which serve to clamp the connecting elements 36,37 and associated rod-like elements 30 to the joining elements 40.

With reference again to FIG. 1, the joining element 40 has a substantially spherical peripheral surface 41 and a central axis 3 which coincides with the z-axis of a Cartesian coordinate system and with a diameter of the joining element 40. The peripheral surface 41 is provided with diametrically opposed first and second anchoring passages 1 and 2 which are disposed at opposite ends of the diameter corresponding to the central axis 3. The anchoring passages 1,2 are in the form of T-grooves and each is designed to receive the head of a single complementary element which resembles a T-bolt. Such a complementary element is represented by the connecting element 36,37 of FIG. 3 which has the general configuration of a T-bolt. As best seen from FIG. 1 in combination with FIG. 2, each of the anchoring passages 1,2 includes an opening which, as observed along the central axis 3, is in the form of an elongated slot. Each anchoring passage 1,2 further includes an undercut, rounded recess.

Referring to FIG. 1, the joining element 40 is bisected by a central plane 8 normal to the central axis 3 and a third anchoring passage 4 extends circumferentially of the joining element 40 along the central plane 8. The anchoring passage 4 is circular, that is, circumferentially complete, and is centered between the first and second anchoring passages 1,2. The anchoring passage 4 is in the form of a T-groove and is designed to receive the heads of several of the complementary connecting elements 36,37 of FIG. 3 which serve to connect the rod-like elements 30 to the joining element 40.

Figure 2:
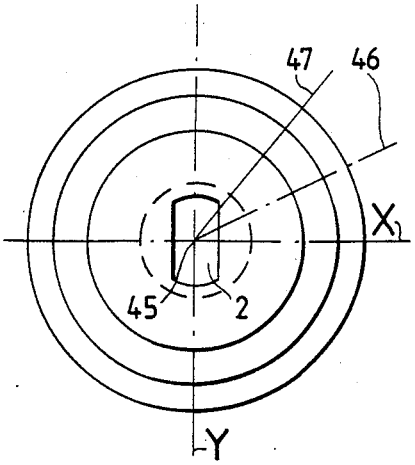
FIG. 2 is a plan view of the joining element of FIG. 1.
Figure 3:
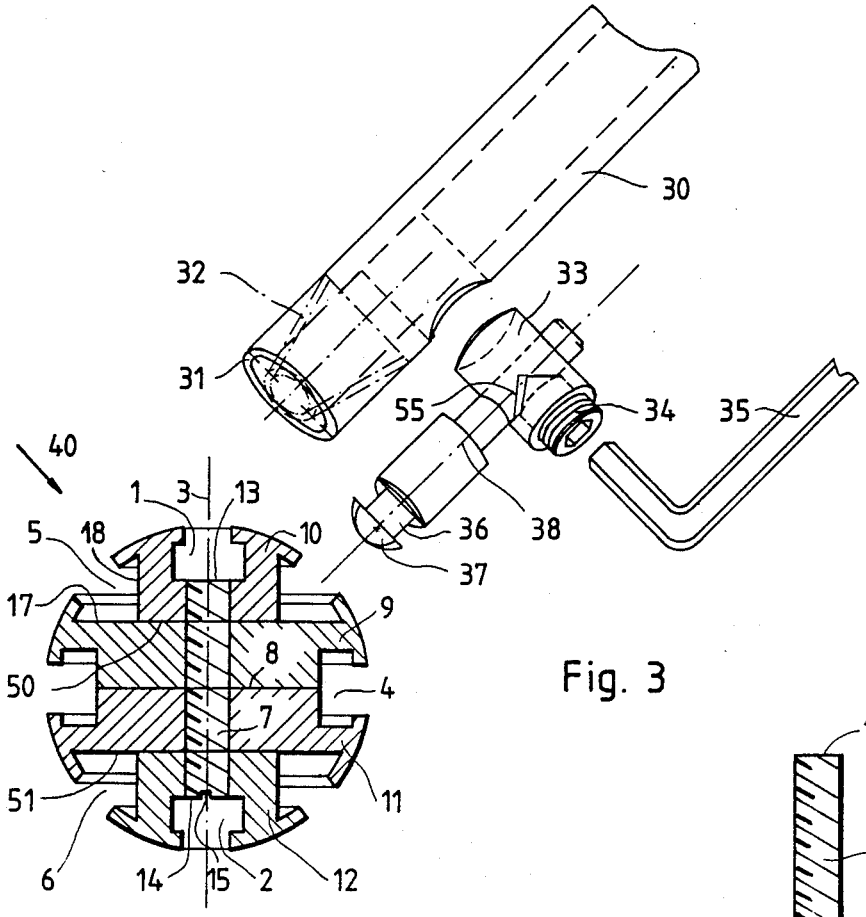
FIG. 3 is a sectional view of the joining element of FIG. 1, as well as a side view of a T-bolt and rod also constituting part of the assembly of prefabricated components, and illustrates the manner of connecting the rod to the joining element.

Using identical mounting means, the anchoring passages 1,2,4 allow the rod-like elements 30 of FIG. 3 to be secured to the joining element 40 so as to extend along the x-axis, y-axis and z-axis of a Cartesian coordinate system. The anchoring passage!4 further allows the rod-like elements 30 to be secured to the joining element 40 in such a manner that the elements 30 extend along rays which radiate outwardly from the center 45 of the joining element 40 in the x,y plane and at angles to the x-axis and y-axis. These rays correspond to an angle of 0° in a polar coordinate system and two such rays 46 and 47 are shown in FIG. 2.

Referring again to FIG. 1, the illustrated embodiment of the joining element 40 is provided with an additional anchoring passage 5 between the anchoring passages 2 and 4 as well as an additional anchoring passage 6 between the anchoring passages 1 and 4. Each of the additional anchoring passages 5 and 6 extends circumferentially of the joining element 40 along a plane normal to the central axis 3 and parallel to the central plane 8. The additional anchoring passages 5 and 6, which are circular, i.e., circumferentially complete, are thus parallel to the central anchoring passage 4. Each of the additional anchoring passages 5 and 6 is in the form of a T-groove and is designed to receive the head of one or more of the complementary connecting elements 36,37 of FIG. 3. The anchoring passages 5 and 6 are arranged to mount the rod-like elements 30 on the joining elements 40 in such a manner that the elements 30 extend along rays 48 which radiate outwards from the center 45 of the joining element 40 at a non-zero angle delta in a polar coordinate system. It will be observed that the angle delta is measured between a ray 48 and the central plane 8 which bisects the joining element 40 and central anchoring passage 4 and corresponds to the x,y plane of a Cartesian coordinate system. The angle delta, which is here shown to be 45°, may range from 1° to 89°. Preferably, however, the angle delta is 30°, 45° or 60°.

Each of the additional anchoring passages 5,6 may be formed individually in a hemispherical joining element. Alternatively, the two additional anchoring passages 5,6 may be formed together in a spherical joining element 40 so as to be parallel to the central anchoring passage 4.

In FIG. 3, the same reference numerals as in FIG. 1 are used to identify similar items.

FIG. 3 shows that the joining element 40 is divided into separate sections 9,10,11,12 along the central plane 8 which bisects the central anchoring passage 4 and along two additional planes 50 and 51 which respectively traverse the additional anchoring passages 5 and 6. The additional planes 50,51 are parallel to the central plane 8 and hence normal to the central axis 3 of the joining element 40. The additional plane 50 traverses the additional anchoring passage 5 and is disposed such that a first bounding surface 17 of the additional anchoring passage 5 is located in the additional plane 50. The additional anchoring passage 5 has a second bounding surface 18 which is normal to the first bounding surface 17. Similarly, the additional plane 51 traverses the additional anchoring passage 6 and is positioned in such a manner that a first bounding surface of the additional anchoring passage 6 is situated in the additional plane 51. The additional anchoring passage 6 again has a second bounding surface which is perpendicular to its first bounding surface.

Figure 4:
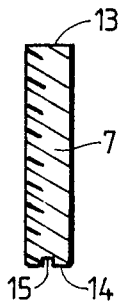
FIG. 4 is a sectional view showing certain details of the joining element of FIG. 1.

The sections 9,10,11,12 of the joining element 40 are held together by a threaded bolt 7 which is arranged so that the longitudinal axis thereof coincides with the central axis 3 of the joining element 40. The threaded bolt 7 is headless and has two end faces 13 and 14. The end face 13 at least partly constitutes the bottom of the first anchoring passage 1 while the end face 14 at least partly constitutes the bottom of the diametrically opposed second anchoring passage 2. As shown in FIG. 4, the threaded bolt 7 is provided with a slit 15 for the purpose of preventing rotation of the bolt 7 during threading of the sections 9,10,11,12 thereon.

The bolt 7 may be replaced by other connecting means such as rivets, welds, etc.

FIG. 3 illustrates the manner in which the rod-like element 30 is attached to the joining element 40. As indicated earlier, the rod-like element 30 is mounted on the joining element 40 through the agency of the connecting element 36,37 which resembles a T-bolt. The connecting element 36,37, which is free of threads, is dimensioned so that it can be inserted in any one of the circumferential anchoring passages 4,5,6 and rotated 90° about its longitudinal axis 38. The connecting element 36,37, which is also receivable in the diametrically opposed first and second anchoring passages 1,2, is designed to be complementary to the anchoring passages 1,2,4,5,6.

The connecting element 36,37 has a shank which is provided with a conical recess 55 disposed transverse to the longitudinal axis 38 of the connecting element 36,37. The conical recess 55 is designed to receive the clamping element 34 which is here in the form of a screw having a conical tip or end. The clamping element 34 is movable in the conical recess 55 transversely of the longitudinal axis 38 of the connecting element 36,37 and the conical tip of the clamping element 34 can be moved into and out of engagement with the conical surface of the recess 55 by rotating the clamping element 34, e.g., via an Allen wrench 35. In this manner, the connecting element 36,37 can be releasably clamped to the joining element 40 together with the rod-like element 30. As illustrated, the female thread for the clamping element 34 can be formed in a sleeve 33 which is capable of being inserted in the rod-like element 30. Alternatively, such female thread can be cut directly in the rod-like element 30.

The rod-like element 30 has an end face 31 which confronts the joining element 40 when the rod-like element 30 is mounted thereon. The rod-like element 30 can be substantially uniform throughout its length up to the end face 31. However, the dimensions of the end face 31 may be excessive when a large number of the rod-like elements 30 must be mounted on the joining element 40. In such an event, conical rings constituting part of the assembly of prefabricated structural components may be interposed between the respective rod-like elements 30 and the joining element 40. The conical rings are arranged so that the smaller-diameter ends of the same confront the joining element 40 thereby effectively reducing the sizes of the rod-like elements 30 and end faces 31 in the region of the joining element 40. A conical ring 32 is shown in FIG. 3 by dash-and-dot lines at the end of the rod-like element 30.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. An assembly of prefabricated components for lattices or trusses comprising a plurality of rod-like elements; a plurality of joining elements for joining different ones of rod-like elements to one another, each of said joining elements being substantially spherical and having a substantially spherical peripheral surface, and each of said peripheral surfaces being provided with first and second T-grooves disposed diametrically opposite one another as considered along a central axis of the respective joining element, each of said peripheral surfaces also being provided with a third T-groove extending circumferentially of the respective peripheral surface as considered in a plane substantially normal to the respective central axis, and the third groove in each of said joining elements being disposed substantially midway between the respective first and second grooves; a plurality of connecting elements for connecting said rod-like elements to said joining elements, each of said connecting elements resembling a T-bolt, and said connecting elements being free of threads and each having a shank provided with a transverse conical recess, each of said first and second grooves being designed to receive one of said connecting elements, and each of said third grooves being designed to receive a plurality of said connecting elements; and a plurality of screws having conical ends and receivable in said recess for movement transversely of said shanks to thereby releasably clamp said connecting elements and said rod-like elements to said joining elements.

2. The assembly of claim 1, each of said connecting elements being elongated so as to have a longitudinal axis; and wherein each of said peripheral surfaces is provided with additional circumferentially extending T-grooves substantially paralleling the respective third grooves, each of said additional grooves being designed to receive said connecting elements in such a manner that the longitudinal axes thereof define an angle of approximately 30 degrees to approximately 60 degrees with the respective plane.

3. The assembly of claim 2, wherein said additional grooves are designed to receive said connecting elements in such a manner that the longitudinal axes thereof define an angle of approximately 45 degrees with the respective plane.

4. The assembly of claim 2, wherein each of said planes comprises a central plane of the respective third groove.

5. The assembly of claim 2, wherein each of said joining elements comprises at least two separate sections having a pair of substantially flat abutting surfaces which are substantially normal to the respective central axis and are disposed in the region of one of the circumferential grooves, each of said joining elements further comprising a threaded bolt which is designed to hold the respective sections together and is elongated so as to have a longitudinal axis which coincides with the respective central axis.

6. The assembly of claim 5, each of said first and second grooves having a bottom; and wherein each of said threaded bolts has a pair of end faces which respectively constitute at least part of a bottom.

7. The assembly of claim 5, wherein each pair of abutting surfaces is disposed adjacent to a respective preselected additional groove, each of said preselected additional grooves being bounded by a first surface substantially coplanar with the respective pair of abutting surfaces and a second surface substantially perpendicular to the first surface.

8. The assembly of claim 1, wherein each of said joining elements comprises at least two separate sections having a pair of substantially flat abutting surfaces which are substantially normal to the respective central axis and are disposed in the region of the third groove, each of said joining elements further comprising a threaded bolt which is designed to hold the respective sections together and is elongated so as to have a longitudinal axis which coincides with the respective central axis.

9. The assembly of claim 8, each of said first and second grooves having a bottom; and wherein each of said threaded bolts has a pair of end faces which respectively constitute at least part of a bottom.

10. The assembly of claim 1, further comprising a plurality of cone-like rings each having a larger first end and a smaller second end, said rings being mountable between said rod-like elements and said joining elements such that said first ends face the respective joining elements.

* * * * *

UNITED STATES PATENT AND TRADEMARK OFFICE

CERTIFICATE OF CORRECTION

PATENT NO. : 4,932,808

DATED : June 12, 1990

INVENTOR(S) : Walter BÄR et al.

It is certified that error appears in the above-identified patent and that said Letters Patent is hereby corrected as shown below:

On the title page:

Foremost page: [Inventors] - "Rohles" should read --Rohlfs--.

Signed and Sealed this

Twenty-fourth Day of September, 1991

*Attest:*

HARRY F. MANBECK, JR.

*Attesting Officer*

*Commissioner of Patents and Trademarks*